US005170687A

United States Patent [19]

Ratjen et al.

[11] Patent Number: 5,170,687

[45] Date of Patent: Dec. 15, 1992

[54] MACHINE FOR CUTTING STAPLE FIBERS

[75] Inventors: Johann Ratjen, Willenscharen; Holger Brandt, Ehndorf; Sonja Dittscher, Trappenkamp; Heiner Kudrus, Padenstedt, all of Fed. Rep. of Germany

[73] Assignee: Neumag-Neumünstersche Maschinen-Und Anlagenbau GmbH, Neumünster, Fed. Rep. of Germany

[21] Appl. No.: 816,830

[22] Filed: Jan. 3, 1992

[30] Foreign Application Priority Data

Jan. 25, 1991 [DE] Fed. Rep. of Germany ... 9100822[U]

[51] Int. Cl.[5] ..... D01G 1/04

[52] U.S. Cl. ..... 83/343; 83/431; 83/698; 83/913

[58] Field of Search ..... 83/913, 431, 343, 37, 83/698, 346; 19/0.6

[56] References Cited

U.S. PATENT DOCUMENTS

| | | | |
|---|---|---|---|
| 3,062,082 | 11/1962 | Keith | 83/913 X |
| 4,169,397 | 10/1979 | Vehling et al. | 83/913 X |
| 4,343,069 | 8/1982 | McLuskie et al. | 83/913 X |
| 4,577,537 | 3/1986 | Bauch | 83/913 X |

FOREIGN PATENT DOCUMENTS 3240657 1/1989 Fed. Rep. of Germany .

*Primary Examiner*—Douglas D. Watts
*Assistant Examiner*—Kenneth E. Peterson
*Attorney, Agent, or Firm*—Michael J. Striker

[57] ABSTRACT

A machine for cutting staple fibers has a machine frame, a cutter holder supported rotatably relative to the machine frame and having an axis, a pressing member supported rotatably and having an axis of rotation which forms an obtuse angle with the axis of rotation of the cutter holder. The pressing member is coupled to the cutter holder. A drive drives the cutter holder and the pressing member. The machine has at least one synchronizing hinge having an inner hinge member and an outer hinge member for mounting the cutter holder and the pressing member.

9 Claims, 4 Drawing Sheets

MACHINE FOR CUTTING STAPLE FIBERS

BACKGROUND OF THE INVENTION

The present invention relates to a machine for cutting staple fibers. More particularly, it relates to machines of this type which have a machine frame, a rotatable cutter holder, a rotatable pressing member with a rotary axis inclined to the rotary axis of the cutter holder, a coupling between the cutter holder and the pressing member, and a drive for the cutter holder and the pressing member.

Known machines for cutting staple fibers which are recommended for cutting standard fibers are not suitable for loadings which occur during cutting fiber cables of extremely rigid material such as for example poly-p-phenylenterephthalamide. The cutting forces are very high due to the high strength. Machine parts undergo elastic and plastic deformations. As a result of the deformations the cutting geometry is unfavorably changed. This leads to errors in cutting and unfavorable staple diagram. The power consumption is significantly higher than in the case of standard fibers. With the use of hard metal cutters recommended for cutting high strength fibers, increased cutter breaks take place.

Some modern staple fiber cutting machines of different manufacturers are provided with a rotation symmetrical cutter holder arranged on a driven shaft. A plurality of uniformly distributed cutters extend from an outer surface for receiving a winding. A rotation-symmetrical pressing member is located opposite to the cutter blades and is freely rotatable without its own drive. In operation the winding is pressed against the cutter blades, and the cable is cut. The pressing member rolls rotatably on the winding. The drive moment which is required for it is transferred by friction from the winding to the pressing member. A corresponding tangentially directed friction force which produces a bending moment in the cutters acts between the winding and the cutter blades. A typical fiber cutting machine of this type is disclosed in the German document DE-OS 2,939,154.

It has to be mentioned that a special embodiment of this staple fiber cutting machine described in the German document DE-OS 3,108,096. Here the cutter holder is arranged on a driven shaft which is supported in a housing mounted on the machine frame. A part of the housing is formed as an inclined bearing bushing for the pressing member. The cutter holder and the pressing member are coupled for example by magnets. The magnetic coupling can transfer however only weak torque and serve only for driving the pressing member in rotation at a starting point before inserting of the cables, so that no sliding friction is produced between the winding and the pressing member during the start. The significantly higher drive moment required after reaching the stationary conditions is transferred similarly to the first mentioned machine, substantially through the winding from the cutter holder to the pressing member. The bending moments occurring in the cutters are reduced under the action of the magnet only in insignificant values.

Another staple fiber cutting machine with some similar structural elements is disclosed in the U.S. Pat. No. 3,062,082. Here the cutter holder is supported rotatably on a shaft part which is mounted at its one side on a machine frame. The pressing member is supported on a seal which is mounted on the shaft part and has a cylindrical inclined outer surface. A flexible ring disc is provided between the cutter holder and the pressing member to form a coupling. Such a coupling changes generally at a uniform angular speed into a non-uniform angular speed which is superposed by periodical fluctuations. The amplitude of the fluctuations depends on the value of the angle between the axes of the driven and driving system. The coupling can transfer only small torques.

Another staple fiber cutting machine is disclosed in FIG. 2 of the German document DE-OS 2,811,491. Its rotatably supported cutter holder has an outer surface provided with axis-parallel slots. A pressing member is supported in the hollow cutter holder on an inclined axle. On its periphery it is provided with radial fingers extending in the slots. The fingers in connection with the slots prevent a relative turning between the pressing member and the cutter holder and during the start transmit the required torque from the cutter holder to the pressing member. During the operation the pressing member performs a wobbling movement, so that the fingers reciprocate axially in the slots and simultaneously are periodically tilted. This movement assumes that the fingers have a substantially play in the slots. The non-uniform relative movement between the fingers and the lateral limiting walls of the slots result in local high surface pressure and sliding friction. In the case of a high loading this leads to excessive wear and noise generation, especially since lubrication of the interengaging parts contacting the fiber winding during the operation is not permitted due to the contamination risks. This arrangement is therefore not suitable to transmit high torques during continuous operation.

The same is true with the machine described in the German document DE-PS 3,240,657. In this machine an inner toothing of the pressing member engages in axial grooves of the rotatable cutter holder.

Other staple fiber cutting machines are also known in which in kinematic reverse of the above described machines, a ring-shaped cutter set is arranged immovably on the machine frame. The associated pressing member is formed as a wobbling disc which rolls in the operation on the winding without turning relative to the cutter holder. The cable to be cut is laid by a rotatable, flyer-like guiding member.

A staple fiber cutting machine of this type which includes some known features is disclosed in the German document DE-OS 2,722,788. The pressing member has radial fingers extending into the slots of the stationary cutter holder. As for the cooperation between the pressing member and the cutter holder and the torque transfer, the statements made with respect to the arrangement of FIG. 2 of the German document DE-OS 2,811,491 is true with respect to this machine as well. Its FIG. 1 shows some structural elements. The inner toothing of the pressing member engages here in axial grooves of the stationary cutter holder.

In the manual "Maschinenelemente" of Roloff-/Matek, 11. Auflage 1987, Verlag Friedrich Vieweg und Sohn, Braunschweig/Wiesbaden, pages 414/415, synchronizing hinges are described. The synchronizing hinge has substantially an outer hinge member provided with running grooves, an inner hinge member also provided with running grooves, six balls and a ball cage. The balls located in the running grooves and guided by the ball cage transmit a torque up to a great angle from one hinge member to the other hinge member. It also transfers high torque and are used predominantly for the single wheel drive of motor vehicles and also in general machine building in the cases in which the angle changes during the operation.

SUMMARY OF THE INVENTION

Accordingly, it is an object of the present invention to provide a machine for cutting staple fibers of extremely high strength wherein continuous operation high torques can be transferred between a cutter holder or a cutter set and a pressing member in uniform, wear-free and noise-free manner, without bending of the cutters under the action of tangential forces.

In keeping with these objects and with others which will become apparent hereinafter, the machine for cutting staple fibers in accordance with the present invention can be designed with several modifications.

In accordance with one modification, a machine for cutting staple fibers has a machine frame, a cutter holder supported rotatably relative to the machine frame and having an axis, a pressing member supported rotatably and having an axis of rotation which forms an obtuse angle with the axis of rotation of the cutter holder, the pressing member being coupled to the cutter holder, means for driving the cutter 20 holder and the pressing member, a connecting shaft, two synchronizing hinges each having an inner hinge member and an outer hinge member and each having a hinge point which is spaced from an apex of the axes, one of the hinge members of the hinges being mounted on the cutter holder, one of the hinge members of another of the hinges being mounted on the pressing member, and both remaining of hinge members being mounted on the connecting shaft.

In accordance with another modification of the invention a machine for cutting staple fibers has a machine frame, a cutter holder supported rotatably relative to the machine frame and having an axis, a pressing member supported rotatably and having an axis of rotation which forms an obtuse angle with the axis of rotation of the cutter holder, the pressing member being coupled to the cutter holder, means for driving cutter holder and the pressing member, a connecting shaft, and a synchronizing hinge having an inner hinge member and an outer hinge member, one of the hinge members being connected with the cutter holder while another of the hinge members being connected with the pressing member, the synchronizing hinge having a hinge point which coincides with a point of intersection of the rotary axes.

In accordance with still a further modification of the present invention a machine for cutting staple fibers has a machine frame, a plurality of cutters arranged rotation symmetrically and immovable relative to the machine frame, a system rotatable about a geometrical axis of the cutters and including a fiber guiding member and a rotatable rotation-symmetrical pressing member with an axis of rotation which forms an obtuse angle with geometrical axis of cutters, a connecting shaft, two synchronizing hinges each having an inner hinge member and an outer hinge member and each having a hinge point which is spaced from a point of intersection of the geometrical axis of the cutters and an axis of rotation of pressing member, one of the hinge members of one of the hinges being connected with the machine frame, one of the hinge members of another of the hinges being connected with the pressing member, and remaining ones of the hinge members being arranged on the connecting shaft.

In accordance with still a further modification of the present invention a machine for cutting staple fibers has a machine frame, a plurality of cutters arranged rotation symmetrically and immovably relative to the machine frame, a system rotatable about a geometrical axis of the cutters and including a fiber guiding member and a pressing member supported rotatably and rotation-symmetrically and having a rotary axis which forms an obtuse angle with the geometrical axis of the cutters, means for driving the system, a synchronizing hinge having an inner hinge member and an outer hinge member, one of the hinge members being immovable relative to the cutters, while another of the hinge members being connected with the pressing member, the synchronizing hinge having a hinge point which coincides with a point of intersection of the geometrical axis of the cutters and the rotary axis of the pressing member.

The synchronizing hinges produced by specialized manufacturers in great numbers are made in series production, is easily available and relatively inexpensive.

In accordance with another feature of the present invention, the staple fiber cutting machine has two shaft portions which are connected with one another at an obtuse angle and an supporting arm engaging in an apex region of the obtuse angle and connecting the shaft portions with the machine frame, the cutter holder being supported on one of the shaft portions, while the pressing member is supported on another of the shaft portions.

In addition, the machine has hinge members connected with the cutter holder and the pressing member being arranged at an end side, the shaft portions having openings, and the shaft extending through the openings of the shaft portions from one of the synchronizing hinges to another of the synchronizing hinges.

When the machine is designed in accordance with these features, an extremely high strength of the machine is obtained.

Still another feature of the present invention is that the shaft parts are mounted on the wedge surfaces of the wedge-shaped base body with which the supporting arm engages. Here an advantageous structural modification of the staple fiber cutting machine is achieved.

In accordance with a preferable embodiment of the invention the pressing member is arranged above the cutter holder and coupled with a drive. In this construction a closed space remains under the rotatable cutter holder for supporting and driving elements.

Finally, a holding-down member can be provided at a side which is opposite to the engagement of the pressing member. In this construction the cable windings located in the ring gap can be firmly held.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
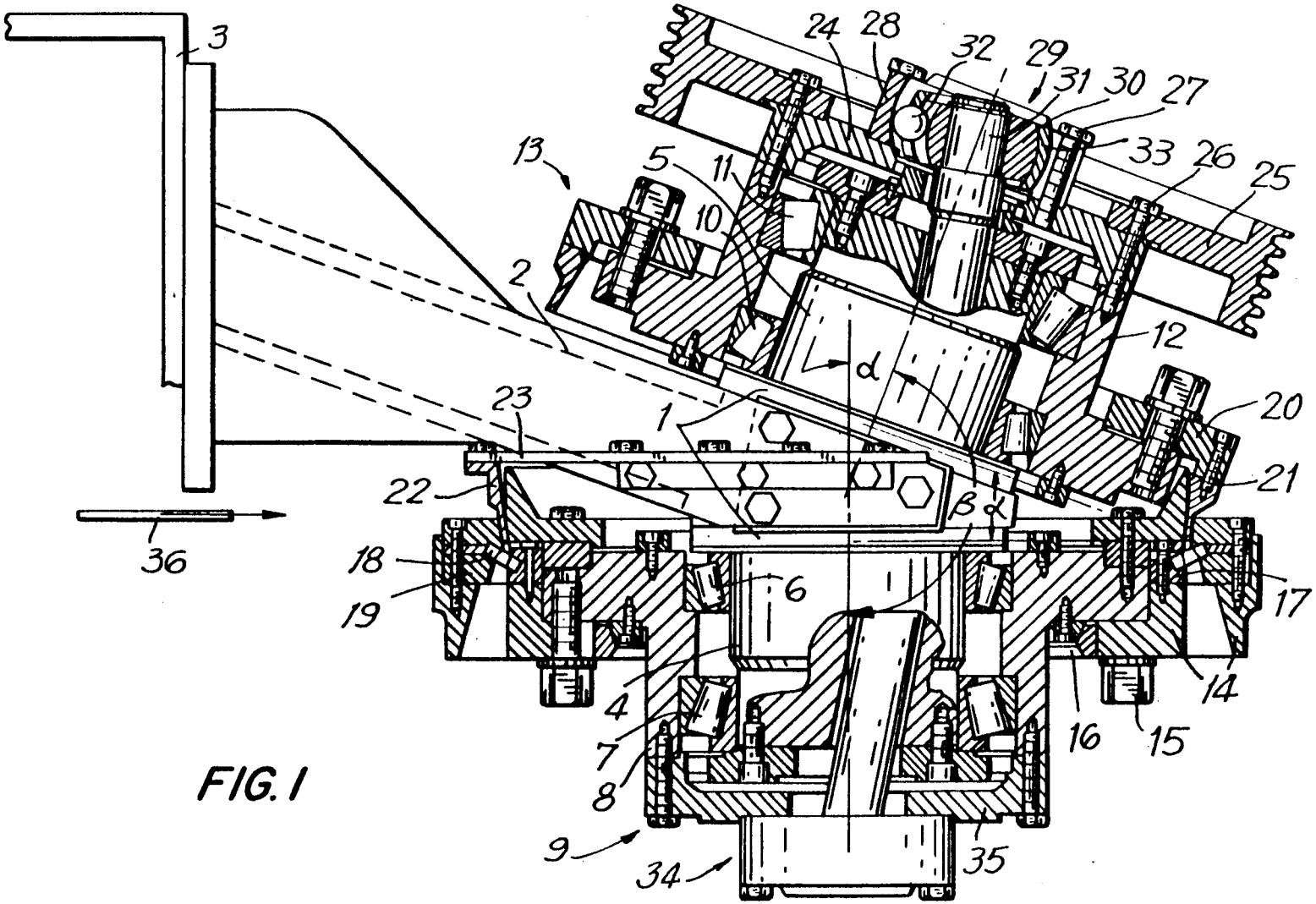
FIGS. 1–4 show several embodiments of a machine for cutting staple fibers in accordance with the present invention wherein the machine shown in FIGS. 2–4 is substantially simplified as compared with the machine shown in FIG. 1.

The round body 1 is connected through a staple supporting arm 2 with a machine frame 3, so that the pointed edge of the wedge faces away of the machine frame 3. A hub 8 of a cutter support 9 is rotatably supported on the outwardly directed shaft part 4 with conical roller bearings 6 and 7. A hub 12 of a pressing member 13 is supported on another upwardly directed shaft part 5 with conical roller bearings 10 and 11. A cap ring 14 is arranged on a flange-like projection of the hub 8. The cap ring is mounted by screws 15 and centered by a steep cone 16.

A cutter ring 17 is screwed on the cap ring 14 and provided with a plurality of radial slots. The axially directed ends of the slots receive cutters 18 which are distributed over the periphery. The cutter blades are directed upwardly and slightly inclined to the axis of rotation. An outer ring 19 is located at the outer ends of the cutters 18. A ring gap is formed between the cutter ring 17 and the outer ring 19 and overlaps the cutter 18. The walls of the ring gap and formed as concentric spherical zones above the cutter blades. A center point of the sphere is a point of intersection of the rotary axis of the cutter holder 9 and the pressing member 13. The inner of the ring gap extends significantly over the outer wall. Underneath the cutter 18 the ring gap extends in direction toward the end surface of the cutter holder 9, which faces away of the cutters 8.

A holding ring 10 is fixed by screws at the periphery of the pressing member 13 on a flange of the hub 12. A pressing ring 21 is mounted on the holding ring 20. The pressing ring has end surfaces which are formed as concentric spherical zones similarly to the walls of the ring gap which are located above the cutter blade. At the side which is close to the pointed edge of the wedge-shaped round body 1, the pressing ring 21 extends with a small play into the ring gap near the cutter blades. At the opposite side which faces the machine frame, a wider gap is formed between the cutter holder 9 and the pressing member 13. A holding down holder 22 extends into the region of the gap into the ring gap and has end surfaces corresponding to the walls of the ring gap. It is connected with the round body 1 by an arm 23.

An end plate 24 and a belt pulley 25 is mounted by screws on the hub 12 of the pressing member 13. The end plate 24 has a central opening. An outer member 28 of a synchronizing hinge 29 which is formed as a fixed hinge is arranged at the outer side of the end plate 24 and mounted by screws 27. An associated inner member 30 is connected with the end of the shaft 31. The facing surfaces of the outer member 28 and the inner member 30 are provided with several running grooves which are uniformly distributed over the circumference. A torque is transmitted between the outer member 28 and the inner member 30 by balls 32 which are received in one running groove of the outer member 28 and the inner member 30. A ring-shaped ball cage 33 has spherical inner and outer surfaces abutting against corresponding surfaces located between the running grooves of the outer member 28 and the inner member 30. The balls 32 are jointly guided by the spherical cage 33 in a plane which divides the angle between the rotary axis of the pressing member 13 and diametrical axis of the shaft 31.

The shaft 31 extends through both shaft parts 4 and 5 which are provided with corresponding openings and also through the base body 1 located between them. Then it extends to a second synchronizing hinge 34 shown on a plan view in the drawing. The synchronizing hinge 34 is analogous to the synchronizing hinge 29 in that it is located centrally on an end plate 35 of the cutter holder 9. The geometrical axis of the shaft 31 extends perpendicularly to the plane of symmetry of the base body 1 and forms a unilateral triangle with the rotary axes of the cutter holder 9 and the pressing member 13. Both hinge points, in which the axis of the shaft 31 intersects the rotary axes of the cutter holder 9 or the pressing member 13, have an equal distance from the point of intersection of the both rotary axes.

A not shown motor can be used as a drive and mounted on the machine frame 3. It is connected with the belt pulley 25 by a not shown belt. A fiber cable 36 is supplied tangentially to the cutter holder 9, and the inner wall of the ring gap above the cutters 8 serves as a winding core. The winding which is formed thereby is pressed during the first half revolution by the pressing ring 21 into a narrow ring gap located over the cutter blades. The winding is compressed in the intermediate space which narrows in the transporting direction and is located between the cutter blades and the end surface of the pressing ring 21. It is pressed against the cutter blades. The cable is cut into pieces in the area surrounding the point where the pressing ring 21 comes closest to the cutter blades. The length of the pieces corresponds to the distance between two neighboring cutters 18.

Figure 2:
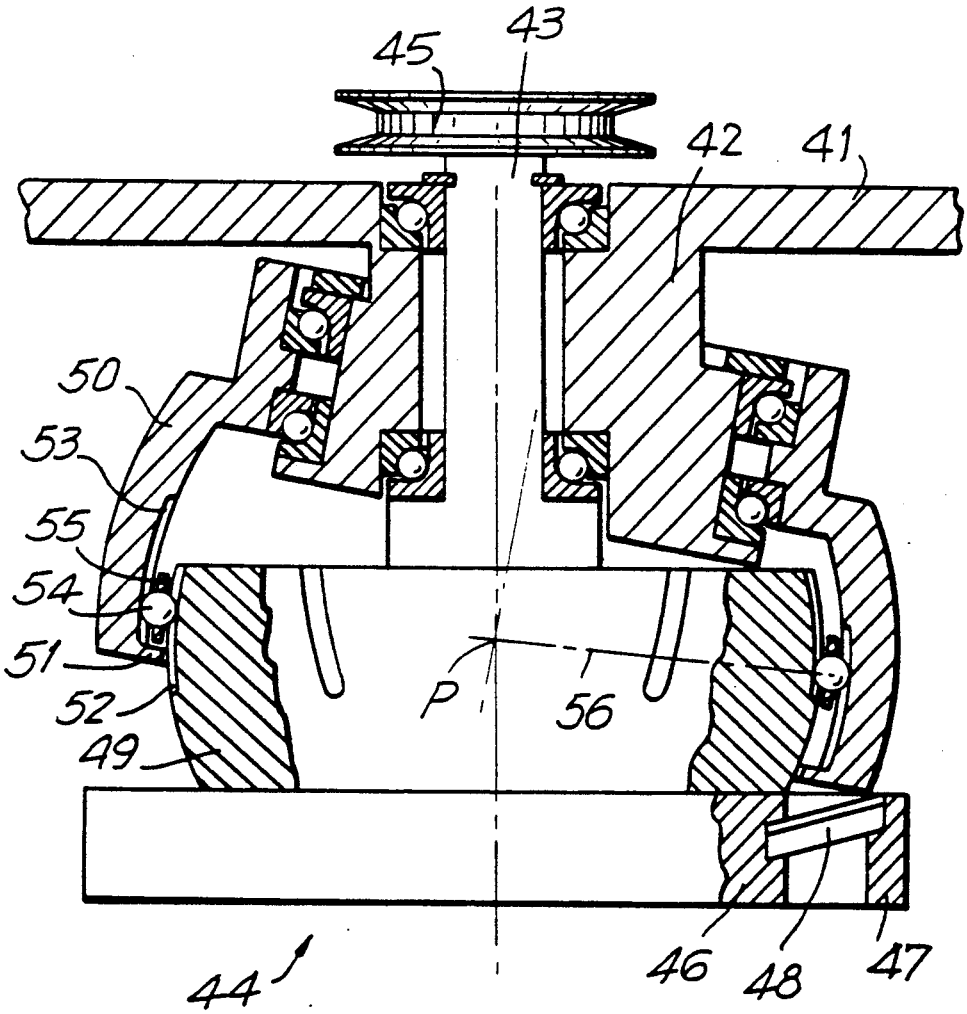

In the embodiment shown in FIG. 2, a thick-walled bearing bushing 42 is connected with a machine frame 41. A shaft 43 of a cutter support 44 is supported on the bearing bushing 42. The cutter holder 44 is driveable by a motor through a belt pulley 45 arranged on the shaft 43.

The cutter holder 43 includes substantially a disc 46 and a coaxial outer ring 47. A ring gap is provided between the disc 46 and the outer ring 47 and overlapped by a plurality of radial cutters 48 arranged at identical angular distances. The cutter blades face the bearing bushing 42 and form an angle of 70°–80°, with the rotary axis of the cutter holder 44.

A ring body 49 sits on the side of the disc 46, which faces the bearing bushing 42. Its outer surface is formed as a spherical zone and is directly connected with the outer surface of the disc 46, or in other words, with the inner limiting wall of the ring gap.

A pressing member 50 is supported on the inclined cylindrical outer surface of the bearing bushing 42, so that its rotary axis forms an obtuse angle of approximately 165°–175° with the rotary axis of the cutter holder 44. The apex of this angle coincides with the center point P of the spherical zone formed by the outer surface of the round body 49. The inclined pressing member 50 has a spherical inner surface with an apex also coinciding the point P and surround the round body 49 in form of a bell. Its end surface extends at one side to the blades of the cutters 48. At the opposite side a wide opening for supplying the cable to be cut, is formed between the pressing member 50 and the cutter holder 4. An inwardly directed ring-shaped projection 51 is located directly near the end surface on the wall of the pressing member 50 and extends close to the outer surface of the round body 49. A wide gap is formed between the spherical inner surface of the pressing member 50 and the outer surface of the round body 49.

The round body 49 and the surrounding part of the pressing member 50 form a hinge member of a synchronizing hinge, whose hinge point coincides with the point of intersection of both rotary axes. As known for the synchronizing hinges, six running grooves 52 and 53 for balls 54 are formed in the facing spherical surfaces of both hinged members to transmit the torque. A ring-shaped spherical cage 55 serves for guiding the balls 54 and sits with a play in the gap between both hinge bodies. It assumes an inclined position, in which the rotary axes of the cutter holder 44 and the pressing member 50 are mirror-symmetrical relative to the synchronizing plane, or in other words to the plane in which the central points of the balls are rotated.

Figure 3:
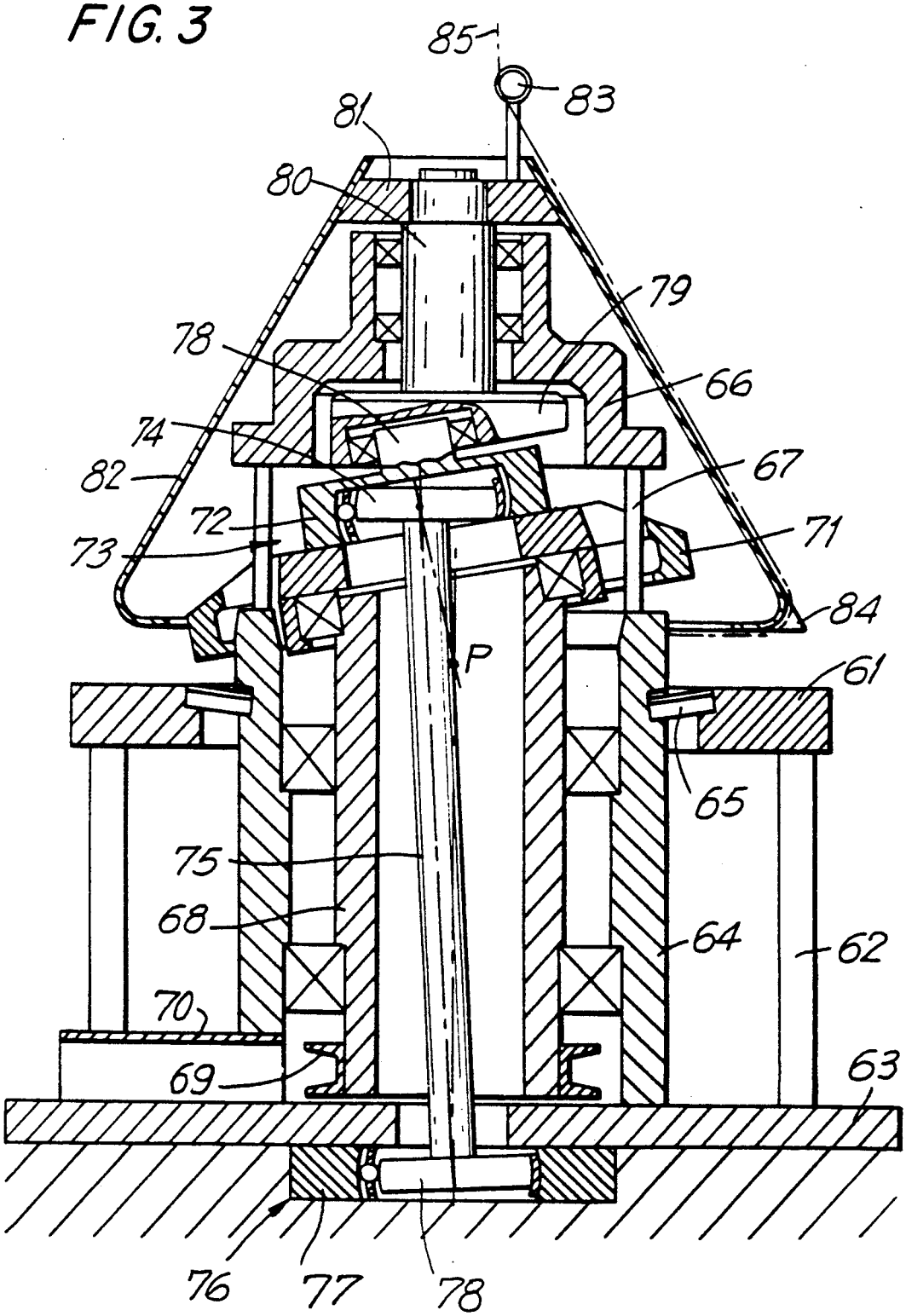
Figure 4:
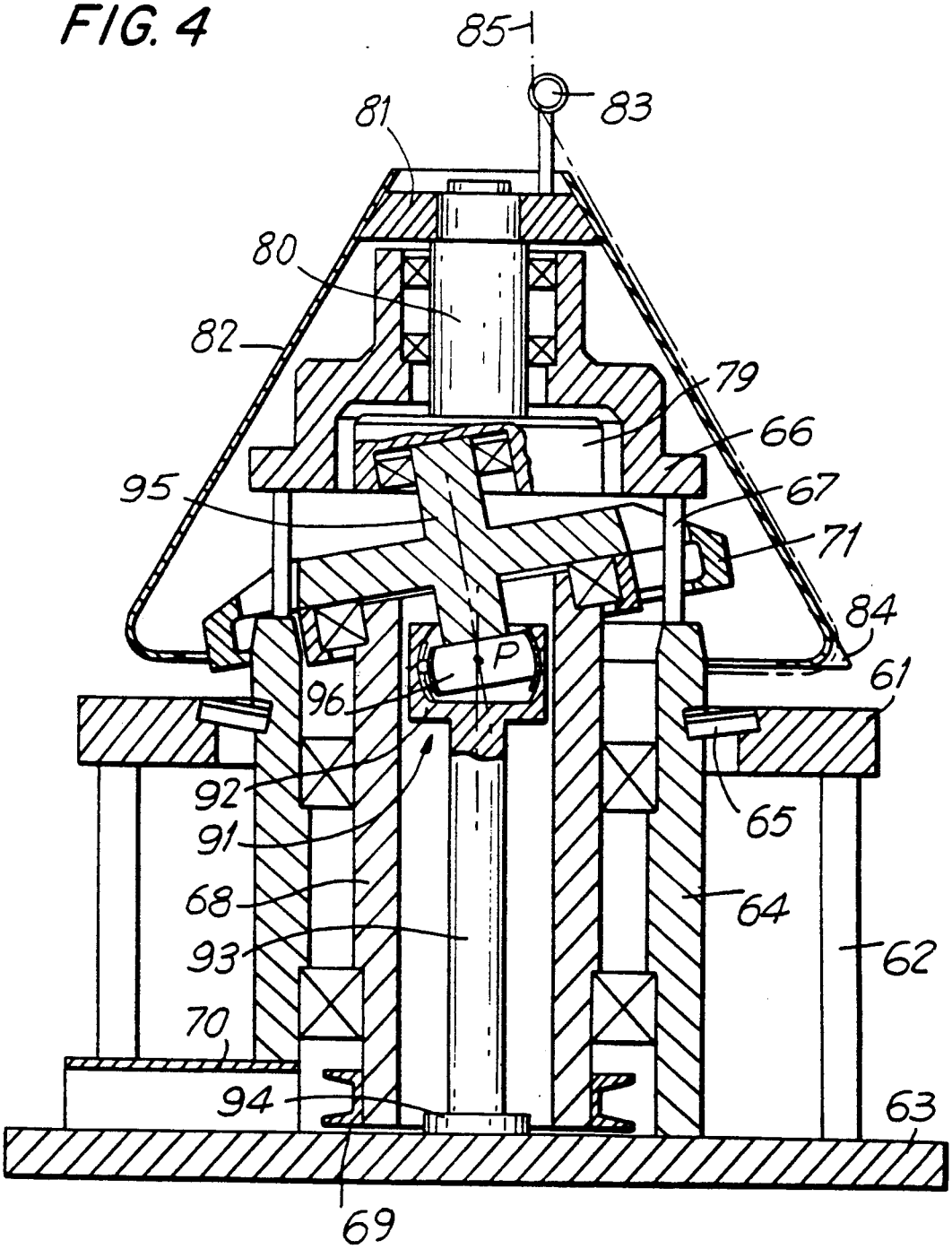

In contrast to the above described embodiments in which the cutter rim and the pressing member rotate during the operation, FIGS. 3 and 4 show machines for cutting staple fibers with stationary cutter rims and wobbling, non-rotatable pressing members.

In FIG. 3, a table plate 61 is firmly connected 20 with a base plate 63 by posts 62. The table plate 62 has a circular opening, and a hollow cylinder 64 connected with the base plate 63 extends through the opening. A ring gap is formed between the outer surface of the hollow cylinder 64 and the edge of the opening of the table plate 61. The ring gap is overlapped by radial cutters 65 arranged in form of a rim. The cutter blades are directed upwardly. A coaxial, rotation-symmetrical bearing body 66 is arranged is arranged at a distance above the hollow cylinder 64 and has a diameter which is increased in steps with the increasing distance from the base plate 63. It is connected with the hollow cylinder 64 by several circumferentially distributed vertical pipes 67. The above described parts belong the stationary machine frame.

A hollow shaft 68 is rotatable supported in the 10 hollow cylinder 64 and extends outwardly beyond the upper end of the hollow cylinder 64. It is provided with a belt pulley 69 for a not shown drive. A belt housing 70 is mounted on the base plate 53 for a not shown belt. The upper end surface of the hollow shaft 68 is inclined to the axes. A pressing member 61 is supported on an adjoining inclined cylindrical outer surface, so that its axis intersects at an obtuse angle the axis of the machine or in another words the axis of the rim-like cutter set, in the point P. The pressing member 71 has the shape of a circular disc provided with a large coaxial opening. It also has a plurality of holes located near the edge and having edges which surround the pipes 67 with a sufficient distance. The diameter of the pressing member 71 corresponds substantially to the diameter of the opening of the table plate 61. A wedge-shaped intermediate space is provided between it and the table plate 61 due to its inclined position. The edge of the pressing member 71 overlaps the upper edge of the hollow cylinder 64 in the region of the pointed edge of the wedge. The outer surface of the hollow cylinder 64 above the cutter blades is formed as spherical zone with a center point P.

An outer hinge member 72 of a synchronizing hinge 73 is mounted on the upper side of the pressing member 71. An associated inner hinge member 74 fixedly sits on an end of a shaft 75. The shaft extends through the coaxial opening of the pressing member 71, the interior of the hollow shaft 68 and an opening in the base plate 63, to a second synchronizing hinge 76. An outer hinge member 77 of the synchronizing hinge 76 sits under the base plate 63 and is fixedly connected with it. An associated inner hinge member 78 sits on the other end of the connected shaft 75. The hinge points of both synchronizing hinges 73 and 76 are arranged at different distances from the intersecting point P.

The outer hinge members 72 of the synchronizing hinge 73 has a cover plate. A coaxial shaft portion 78 is mounted on the outer surface of the cover plate. It is rotatably supported in flat-cylindrical rotary member 79 which has an axis coinciding with the machine axis. The bearing of the shaft part 78 is located inclined and eccentrical in the rotary member 79. The rotary member 79 at its lower side has an incline which is formed as a wedge and corresponds to the inclined position of the pressing member 71. Therefore, the facing surfaces of the rotary member 79 and the outer hinge member 72 form a gap of a uniform small width.

The rotary member 79 is fixedly connected with the lower end of the shaft 80 which is rotatably supported in the bearing member 66. A conical downwardly extending hood 82 is mounted on the upper end of the shaft 8 by a ring-shaped intermediate piece 81. The upper end of the shaft 8 extends over the bearing member 66. The hood 82 extends close to the table 61 and projects with its lower edge radially over the rim of the cutters 65. Fiber guiding members 83 and 84 for fibers 85 supplied approximately parallel to the machine axis are mounted on the intermediate piece 81 and on the lower edge of the hood 82.

During the operation the hollow shaft 75 is driven in rotation by the above mentioned drive. Due to the inclined support, a wobbling movement is imparted to the pressing members 71, such that its axis moves over a conical surface without being rotated. The pressing point, or in other words, the point in which the pressing member 71 comes closest to the cutters 65, runs on the stationary cutter rim. The shaft part 78 which is eccentrically supported in the rotary member 79 acts so that the rotary member 79 and also the shaft 80 and the hood 82 are rotated as well. The fiber guide 84 lays the fibers 85 in a manner of a flyer directly above the cutter 65 tangentially on the outer wall of the hollow cylinder 64 which forms the winding body, and approximately opposite to the pressing point. In the surrounding area of the pressing point, the winding is pressed against the blades of the cutter 65 and therefore is cut.

The embodiment of FIG. 4 substantially corresponds to the embodiment of FIG. 3. The parts which are shown in FIG. 4 and correspond to the respective parts of FIG. 3 are identified with the same reference numerals and not described in detail.

In deviation from FIG. 3, the coupling between the pressing members 71 and the stationary machine frame which surrounds the cutter rim, has only one synchronizing hinge 91. A bell-shaped outer hinge member 92 is fixedly connected with the column 93. The column 93 is arranged coaxially in the interior of the hollow cylinder 64 and the hollow shaft 75 and mounted with its foot 94 on the base plate 63. It is therefore immovable relative to the cutter set. An associated inner hinge member 96 is mounted on the lower end of the shaft 95, on which the pressing member 78 is arranged coaxially. The upper end of the shaft 95 is rotatably supported in the rotary member 79. The bearing is located inclined and eccentrical in the rotary member 79, so that the axis of the shaft 75 forms an obtuse angle with the machine axis with an apex point P corresponding to the hinge point of the synchronizing hinge 91.

As for the operation of the embodiment of FIG. 4, it corresponds to the operation of the embodiment of FIG. 3.

It will be understood that each of the elements described above, or two or more together, may also find a useful application in other types of constructions differing from the types described above.

While the invention has been illustrated and described as embodied in a staple fiber cutting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A machine for cutting staple fibers, comprising a machine frame; a plurality of cutters arranged rotation symmetrically and immovably relative to said machine frame; a system rotatable about a geometrical axis of said cutters and including a fiber guiding member and a pressing member supported rotatably and rotation-symmetrically and having a rotary axis which forms an obtuse angle with said geometrical axis of said cutters; means for driving said system; a synchronizing hinge having an inner hinge member and an outer hinge member each provided with a running groove, a plurality of balls engaging said running grooves, and a ball cage positioned between said inner hinge member and said outer hinge member and guiding said balls, one of said hinge members being immovable relative to said cutters, while another of said hinge members being connected with said pressing member, said synchronizing hinge having a hinge point which coincides with a point of intersection of said geometrical axis of said cutters and said rotary axis of said pressing member.

2. A machine for cutting staple fibers, comprising a machine frame; a cutter holder supported rotatably relative to said machine frame and having an axis; a pressing member supported rotatably and having an axis of rotation which forms an obtuse angle with said axis of rotation of said cutter holder, said pressing member being coupled to said cutter holder, means for driving said cutter holder and said pressing member; a connecting shaft; and a synchronizing hinge having an inner hinge member and an outer hinge member each provided with a running groove, a plurality of balls engaging said running grooves, and a ball cage positioned between said inner hinge member and said outer hinge member and guiding said balls, one of said hinge members being connected with said cutter holder while another of said hinge members being connected with said pressing member, said synchronizing hinge having a hinge point which coincides with a point of intersection of said rotary axes.

3. A machine for cutting staple fibers, comprising a machine frame; a plurality of cutters arranged rotation symmetrically and immovable relative to said machine frame; a system rotatable about a geometrical axis of said cutters and including a fiber guiding member and a rotatable rotation-symmetrical pressing member with an axis of rotation which forms an obtuse angle with said geometrical axis of said cutters; a connecting shaft; two synchronizing hinges each having an inner hinge member and an outer hinge member and each having a hinge point which is spaced from a point of intersection of said geometrical axis of said cutters and an axis of rotation of said pressing member, one of said hinge members of one of said hinges being connected with said machine frame, one of said hinge members of another of said hinges being connected with said pressing member, and remaining ones of said hinge members being arranged on said connecting shaft.

4. A machine for cutting staple fibers, comprising a machine frame; a cutter holder supported rotatably relative to said machine frame and having an axis; a pressing member supported rotatably and having an axis of rotation which forms an obtuse angle with said axis of rotation of said cutter holder, said pressing member being coupled to said cutter holder, means for driving said cutter holder and said pressing member; a connecting shaft; two synchronizing hinges each having an inner hinge member and an outer hinge member and each having a hinge point which is spaced from an apex of said axes, one of said hinge members of said hinges being mounted on said cutter holder, one of said hinge members of another of said hinges being mounted on said pressing member, and both remaining of said hinge members being mounted on said connecting shaft.

5. A machine as defined in claim 4; and further comprising two shaft portions which are connected with one another at an obtuse angle and a supporting arm engaging in an apex region of said obtuse angle and connecting said shaft portions with said machine frame, said cutter holder being supported on one of said shaft portions, while said pressing member is support on another of said shaft portions.

6. A machine as defined in claim 5, wherein said hinge members connected with said cutter holder and said pressing member being arranged at an end side, said shaft portions having openings, and said shaft extending through said openings of said shaft portions from one of said synchronizing hinges to another of said synchronizing hinges.

7. A machine as defined in claim 5; and further comprising a wedge-shaped base body having wedge surfaces, said supporting arm engaging said base body, said shaft portions being mounted on said wedge surfaces of said wedge-shaped base body.

8. A machine as defined in claim 5, wherein said pressing member is arranged above said cutter holder and coupled with said drive means.

9. A machine as defined in claim 5, wherein said pressing member has an engagement point; and further comprising a holding-down member arranged on opposite sides of said engagement point of said pressing member.

* * * * *